US006941844B2

(12) United States Patent
Hile

(10) Patent No.: US 6,941,844 B2
(45) Date of Patent: Sep. 13, 2005

(54) SELF-ADJUSTING LOCKING PLIERS

(76) Inventor: Jeffrey B. Hile, 719 Wexford-Bayne Rd., Wexford, PA (US) 15090

( * ) Notice: Subject to any disclaimer, the term of this patent is extended or adjusted under 35 U.S.C. 154(b) by 0 days.

(21) Appl. No.: 10/706,012

(22) Filed: Nov. 10, 2003

(65) Prior Publication Data

US 2005/0097997 A1 May 12, 2005

(51) Int. Cl.[7] ..... B25B 7/14
(52) U.S. Cl. ..... 81/368
(58) Field of Search ..... 81/368, 369, 370, 81/371, 372, 373, 374, 375

(56) References Cited

U.S. PATENT DOCUMENTS 5,022,290 A * 6/1991 Duffy ..... 81/355
5,056,385 A 10/1991 Petersen
5,609,080 A * 3/1997 Flavigny ..... 81/368
6,065,376 A 5/2000 Khachatoorian
6,227,080 B1 5/2001 Grayo et al.
6,279,431 B1 8/2001 Seber et al.

* cited by examiner

*Primary Examiner*—Jacob K. Ackun, Jr.
(74) *Attorney, Agent, or Firm*—Carothers & Carothers

(57) ABSTRACT

A self-adjusting locking plier having a stationary assembly providing a stationary handle and a stationary jaw and a moveable assembly including an operating lever and a moveable jaw that is supported on the stationary jaw with a slidable pivot connection whereby the moveable jaw is permitted to automatically close down on an object disposed between the jaws for providing self-adjustment for different sized objects to be gripped between the jaws. The operating lever is spring biased to move away from the stationary handle. In addition, a dual link past-dead-center toggle locking mechanism is provided to lock the pliers on to an object gripped between the jaws. The specific arrangement of the locking toggle mechanism in combination with the moveable operating lever to which it is connected in further combination with the fact that the front end of the lever mechanism is connected with a slidable pivot to the stationary jaw provides a self-adjusting locking plier.

20 Claims, 8 Drawing Sheets

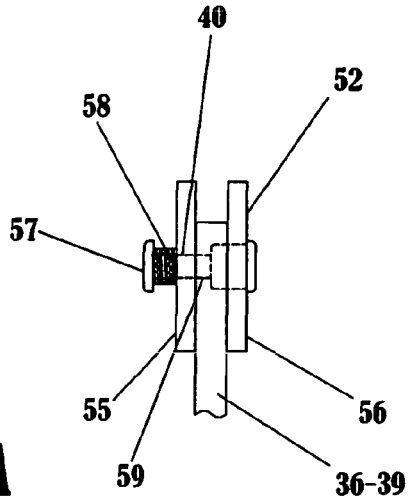
FIG 10-A
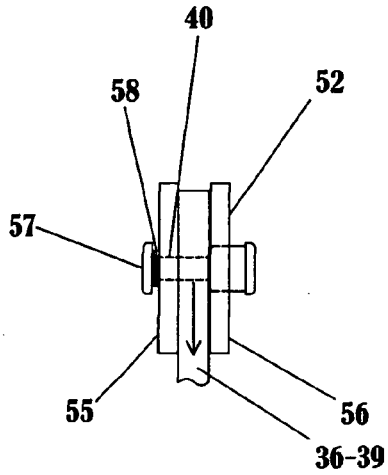
FIG 10-B
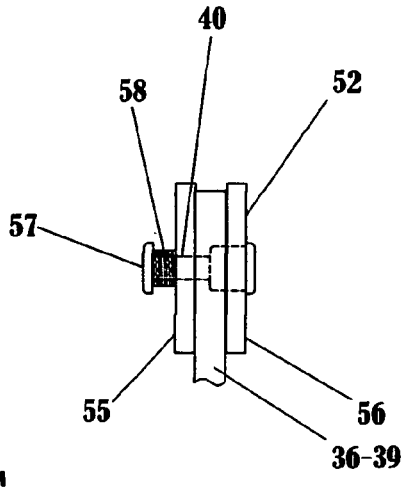
FIG 10-C

SELF-ADJUSTING LOCKING PLIERS

BACKGROUND OF THE INVENTION

This invention relates to pliers, and more particularly, to self-adjusting pliers which also lock with a strong clamping force on an object.

Self-adjusting or auto-adjusting pliers are commonly found on the market. Such pliers have jaws which are self-adjusting accordingly to the size of the work piece to be grasped between the jaws. Examples of such self-adjusting pliers are disclosed in U.S. Pat. Nos. 6,065,376 and 6,279,431.

Also commonly found on the market are locking pliers which incorporate a compound toggle locking mechanism or linkage whereby when the moveable jaw of the plier is adjusted to seize a work piece firmly between the moveable and the fixed jaw and the handles are tightly compressed, the toggle mechanism locks the hand tool onto the work piece. Examples of this type of plier are disclosed in U.S. Pat. No. 5,056,385 (a locking plier sold under the trademark VISE-GRIP) and U.S. Pat. No. 6,227,080.

However, in spite of continuous efforts in this field, no one has been able to design practical and truly functional pliers which are both self-adjusting and locking. It is a principal object of the present invention to provide such self-adjusting locking pliers which are easy to operate, fully functional and inexpensive to manufacture.

SUMMARY OF THE INVENTION

The self-adjusting locking pliers of the present invention include a stationary assembly having an elongated overall shape wherein one end of this stationary assembly forms a stationary handle and the other end of the stationary assembly forms a stationary jaw, and a moveable assembly including an operating lever and a moveable jaw that is supported on the stationary jaw via a first pivot which is comprised of a slidable pivot connection whereby the moveable jaw is permitted to close down on an object disposed between the jaws for providing self-adjustment of the jaws for different sized objects to be gripped between the jaws. The front end of the operating lever is supported on the stationary jaw via a second pivot which is comprised of a slidable pivot connection and the rear end of this operating lever forms a moveable handle. A spring biases the moveable handle away from the stationary handle.

The moveable assembly further includes a first link having its front end supported on the moveable jaw via a third pivot and a rear end that is supported on the operating lever via a fourth pivot at an intermediate point along the operating lever whereby the moveable jaw is caused to close toward the stationary jaw for clamping an item between the jaws when the moveable handle is moved toward the stationary handle. The rear end of the first link is provided with a rearwardly extending protrusion that extends rearwardly beyond the fourth pivot, and a second link is provided wherein the front end thereof is supported on this protrusion of the first link via a fifth pivot. The rear end of the second link is supported on the stationary handle via a sixth pivot at a resting point that is adjustable along the length of this stationary handle, whereby the two links provide a past-dead-center locking toggle mechanism.

A protrusion is also provided on the front end of the second link which is dimensioned for retaining an end of the spring at a position that is located in front of the fifth pivot when the pliers are open and in rear of the fifth pivot when the pliers are closed. A stop mechanism is also provided for preventing the toggle mechanism from going beyond a point of alignment past dead center in either direction upon movement of the moveable handle toward and away from the stationary handle. This combination of elements provides a plier which is both self-adjusting and locking and which may be easily operated without having to learn special operating procedures.

The sixth pivot is adjustable along a length of the stationary handle by means of a slide received in the stationary handle. The slide is displaceable within the stationary handle by means of a thumb bolt or screw that is threadably received in the stationary handle. Thus by very minute adjustments of this thumb screw vernier or fine adjustment of the gripping pressure of the jaws on an object is accomplished when the pliers are locked. Another feature is also desirably provided whereby the sixth pivot is displaceable along the second link to two alternate positions for presetting the jaws for gripping larger or smaller objects.

The slidable first pivot connection may be provided in various forms as is disclosed in the prior art. In the present invention the preferred slidable first pivot connection includes a spring biased pawl and ratchet mechanism with the pawl secured to the moveable jaw by the first pivot and wherein the pivot and pawl are moveable within the slot, which slot extends in the stationary jaw generally transversely to the jaws. The pawl is provided with forwardly facing teeth for engaging a rack of teeth on a front edge of the slot for providing the ratchet, and a spring is connected between the pawl and the stationary assembly for maintaining the pawl teeth normally disengaged from the rack teeth.

BRIEF DESCRIPTION OF THE DRAWINGS

Other objects and advantages appear hereinafter in the following description and claims. The accompanying drawings show, for the purpose of exemplification, without limiting the invention or appended claims, certain practical embodiments of the present invention wherein:

FIGS. 10A, 10B and 10C are enlarged schematic bottom views of the rear portion of the stationary handle of portion shown in FIGS. 7, 8 and 9 sequentially illustrating manipulations to provide alternate setable positions for presetting the jaws for gripping larger or smaller objects.

DETAILED DESCRIPTION OF THE PREFERRED EMBODIMENT

Figure 1:
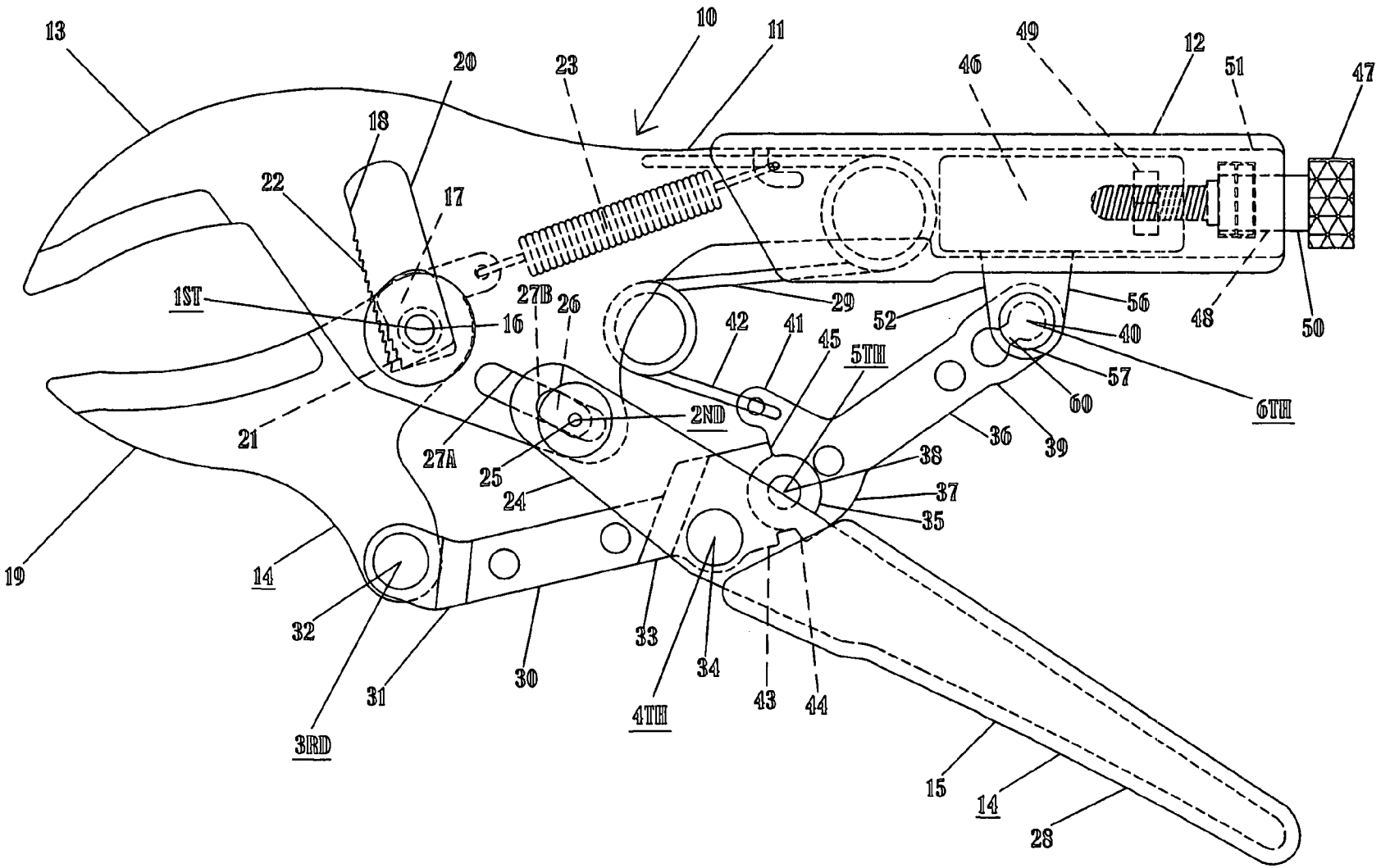
FIG. 1 is a view in side elevation of the self-adjusting locking pliers of the present invention with the jaws shown in the fully open position.

Referring to the drawings, the self-adjusting locking pliers 10 of the present invention is comprised of a stationary assembly 11 having an elongated overall shape wherein the rear end 12 of the stationary assembly 11 forms a stationary handle, and the other or forward end 13 forms a stationary jaw. A moveable assembly 14 includes operating lever 15 that is supported on stationary jaw 13 via first pivot 16 which is comprised of a slidable pivot connection that includes spring biased pawl 17 and ratchet 18. Pawl 17 is secured to moveable jaw 19 by first pivot 16 and the pawl 17 is moveable within slot 20 that extends in stationary jaw 13 generally transversely to the jaws 13 and 19. Pawl 17 is provided with forwardly facing teeth 21 for engaging the rack of teeth 22 which provides ratchet 18 on the front edge of slot 20. Spring 23 is connected between pawl 17 and stationary assembly 11 for maintaining pawl teeth 21 normally disengaged from rack teeth 22.

Since the pliers by necessity must be described with reference to the many respective pivots, the pivot number designations are indicated on the drawings for clarity.

Slidable pivot connection 16 permits moveable jaw 19 to close down on an object disposed between jaws 13 and 19 for providing self-adjustment of the jaws for different size objects to be gripped therebetween. The operating lever 15 is supported at its front end 24 on stationary jaws 13 via second pivot 25 which is comprised of a slidable pivot connection whereby pivot pin 26 is slidably received both within long slot 27*a* in stationary jaw 13 and also within short slot 27*b* in lever 15. The rear end 28 of operating lever 15 provides a moveable handle. This double slot 27*a, b* prevents unwanted contact between elements in order to provide a more compact set of pliers.

Torsion spring 29 biases moveable handle 15 away from stationary handle 11. This moveable assembly further includes a first link 30 having a front end 31 supported on moveable jaw 19 via third pivot 32 and a rear end 33 supported on operating lever 15 via fourth pivot 34 at an intermediate point along operating lever 15 whereby moveable jaw 19 is caused to close toward stationary jaw 13 for clamping an item between the jaws when the moveable handle 15 is moved toward stationary handle 11 against the bias of torsion spring 29.

The rear end 33 of first link 30 is provided with a rearwardly extending protrusion 35 which extends beyond fourth pivot 34. Second link 36 has its front end 37 supported on protrusion 35 of first link 30 via fifth pivot 38. The rear end 39 is supported on stationary handle 12 via sixth pivot 40 at a resting point that is adjustable along a length of stationary handle 12. This link combination of link 30 and 36 provide a past-dead-center locking toggle mechanism.

Figure 2:
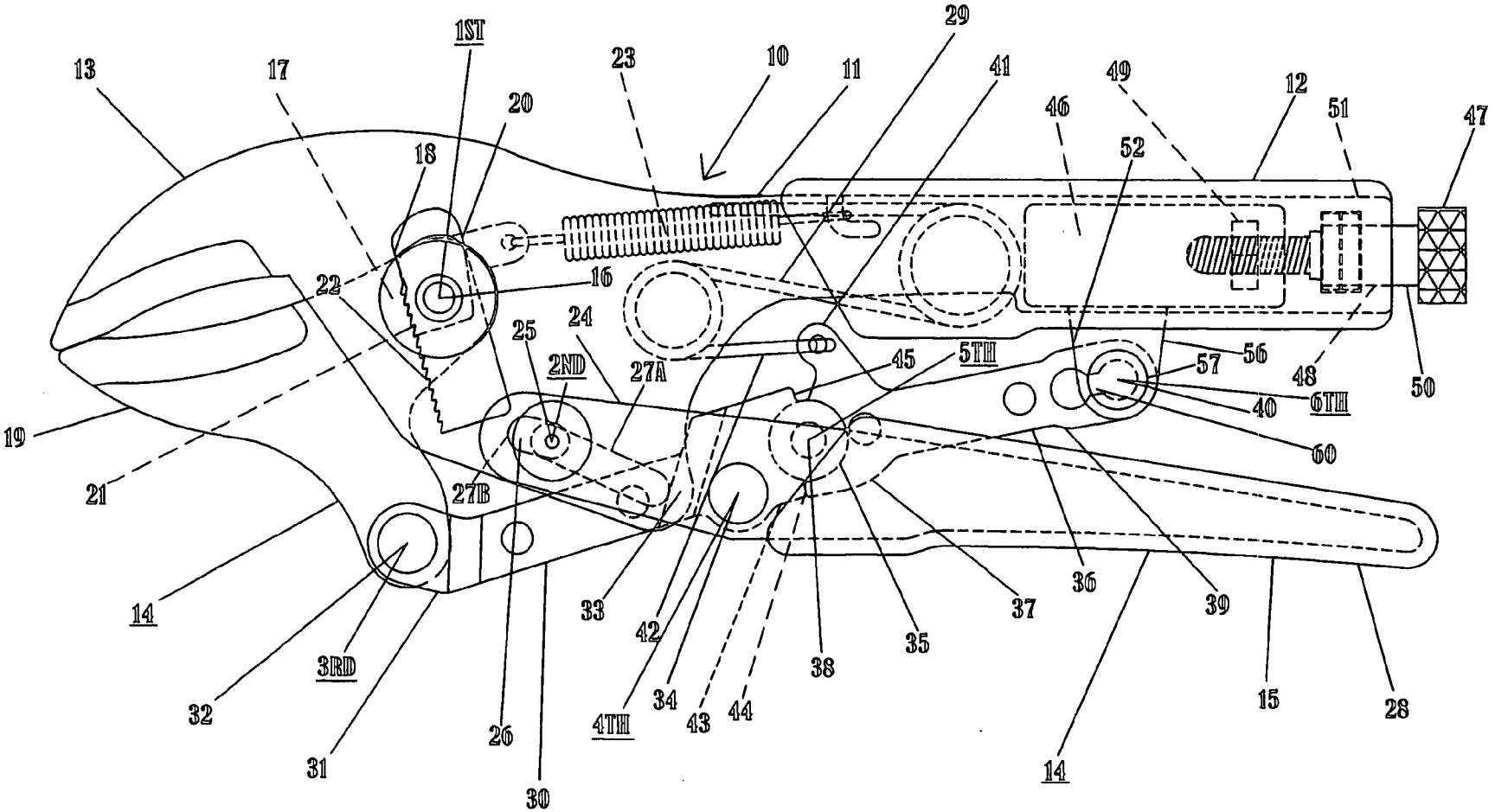
FIG. 2 is a view in side elevation of the pliers shown in FIG. 1 with the jaws in the fully closed and locked position.
Figure 3:
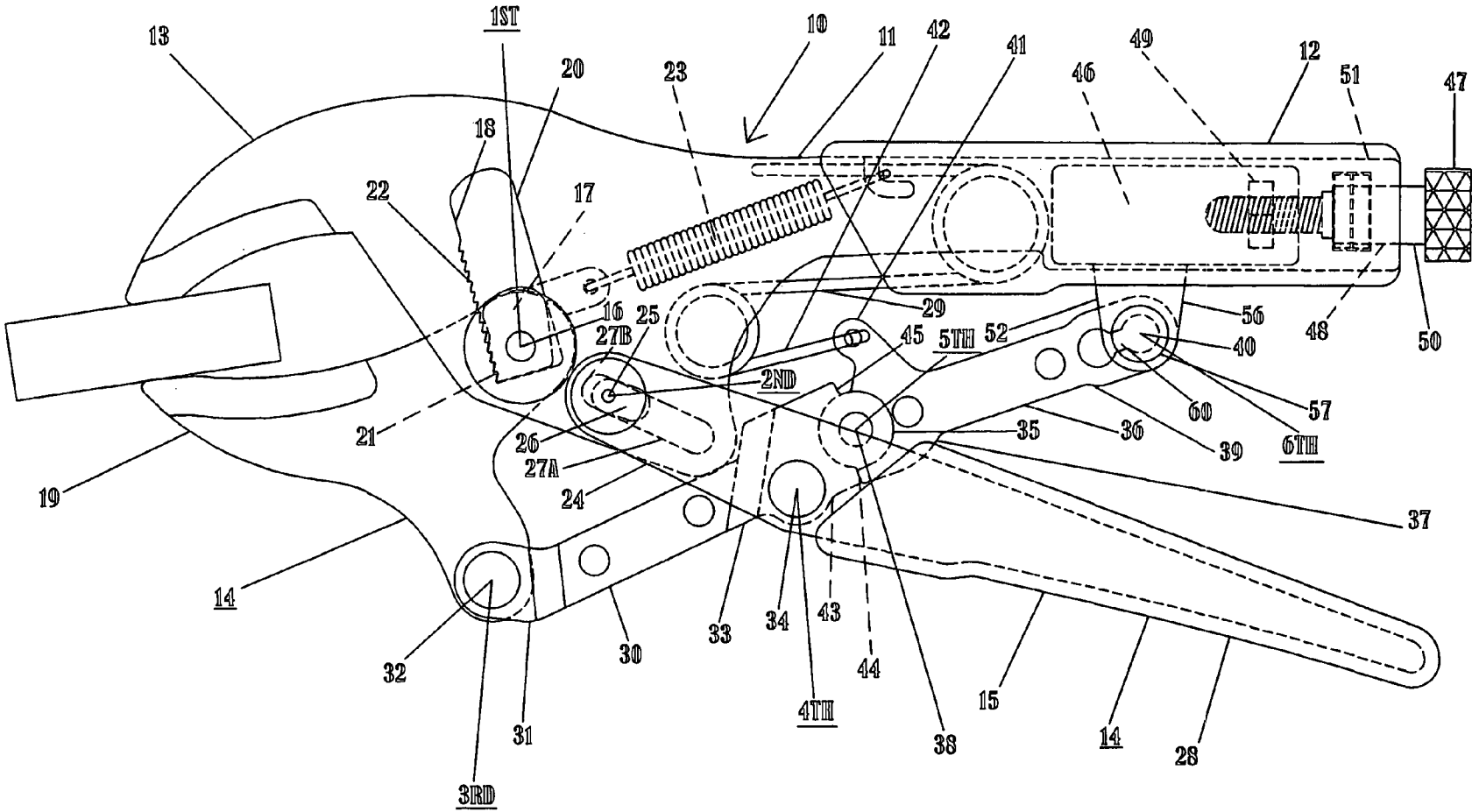
FIG. 3 is a view in side elevation of the pliers shown in FIG. 1 with the jaws closed and locked on a large object.
Figure 4:
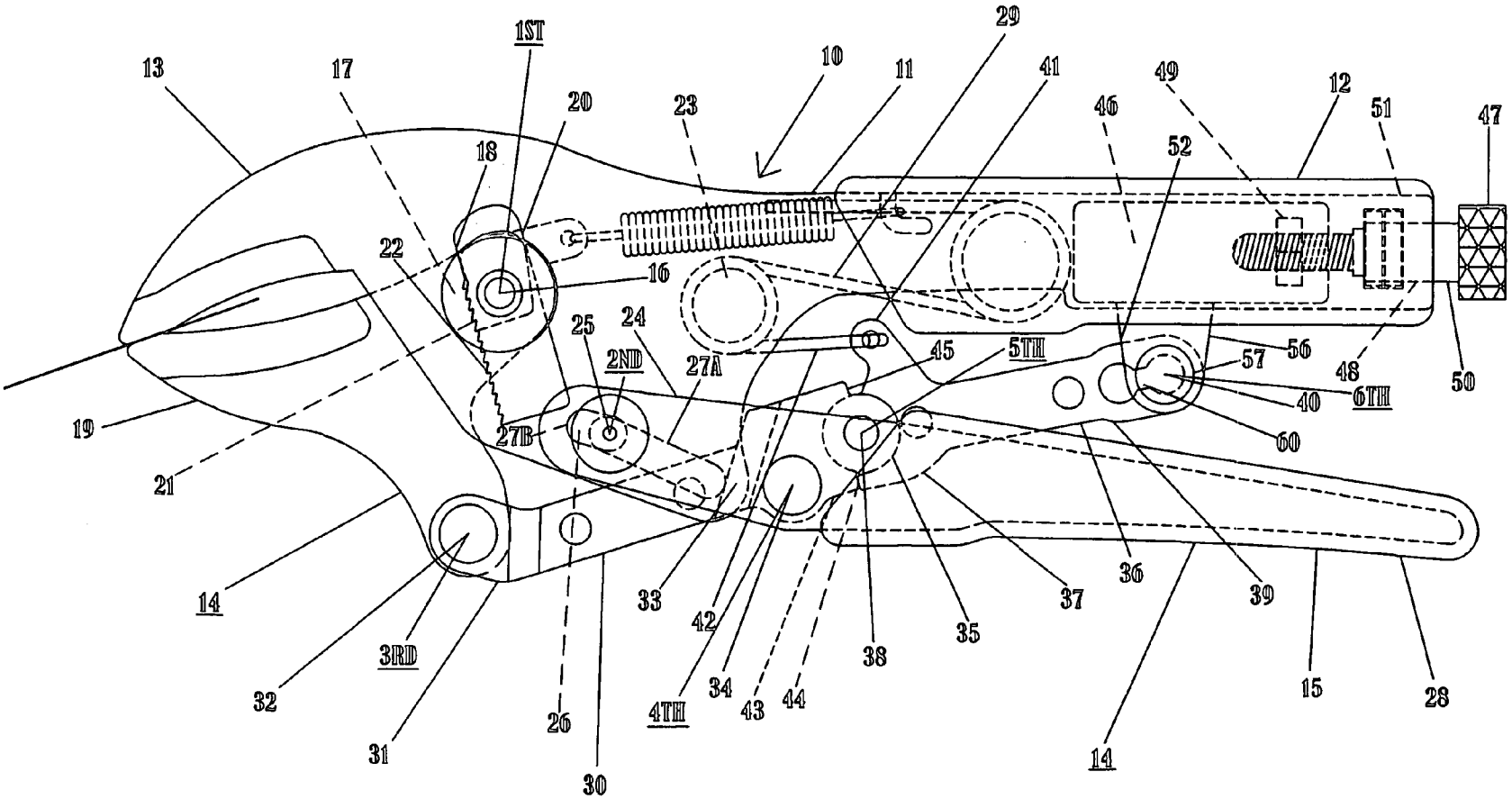
FIG. 4 is a view in side elevation of the pliers shown in FIG. 1 with the jaws closed and locked on a small object.

A protrusion 41 is provided on the front end 37 of second link 36 whereby protrusion 41 is dimensioned for retaining the end 42 of torsion spring 29 at a position located in front of fifth pivot 38 when the pliers are open as seen in FIG. 1 and rear of fifth pivot 38 when the pliers are closed as seen in FIGS. 2, 3 and 4. Spring 29 as shown is a double torsion spring.

A stop mechanism 43 is provided for preventing the toggle mechanism consisting of links 30 and 36 from going beyond a point of alignment past dead center upon movement of the moveable handle 15 either toward or away from stationary handle 12. This point of alignment for the closed position is illustrated in FIGS. 2, 3 and 4 and the stop mechanism 43 in this position engages stop surfaces 44 to thereby prevent the toggle mechanism from protruding inwardly towards stationary assembly 11 any further. Stop mechanism 43 also is provided with stop surfaces 45 which prevent the toggle mechanism consisting of links 30 and 36 from going beyond a point of alignment past dead center upon movement of the moveable handle away from the stationary handle to the open position as illustrated in FIG. 1.

Figure 5:
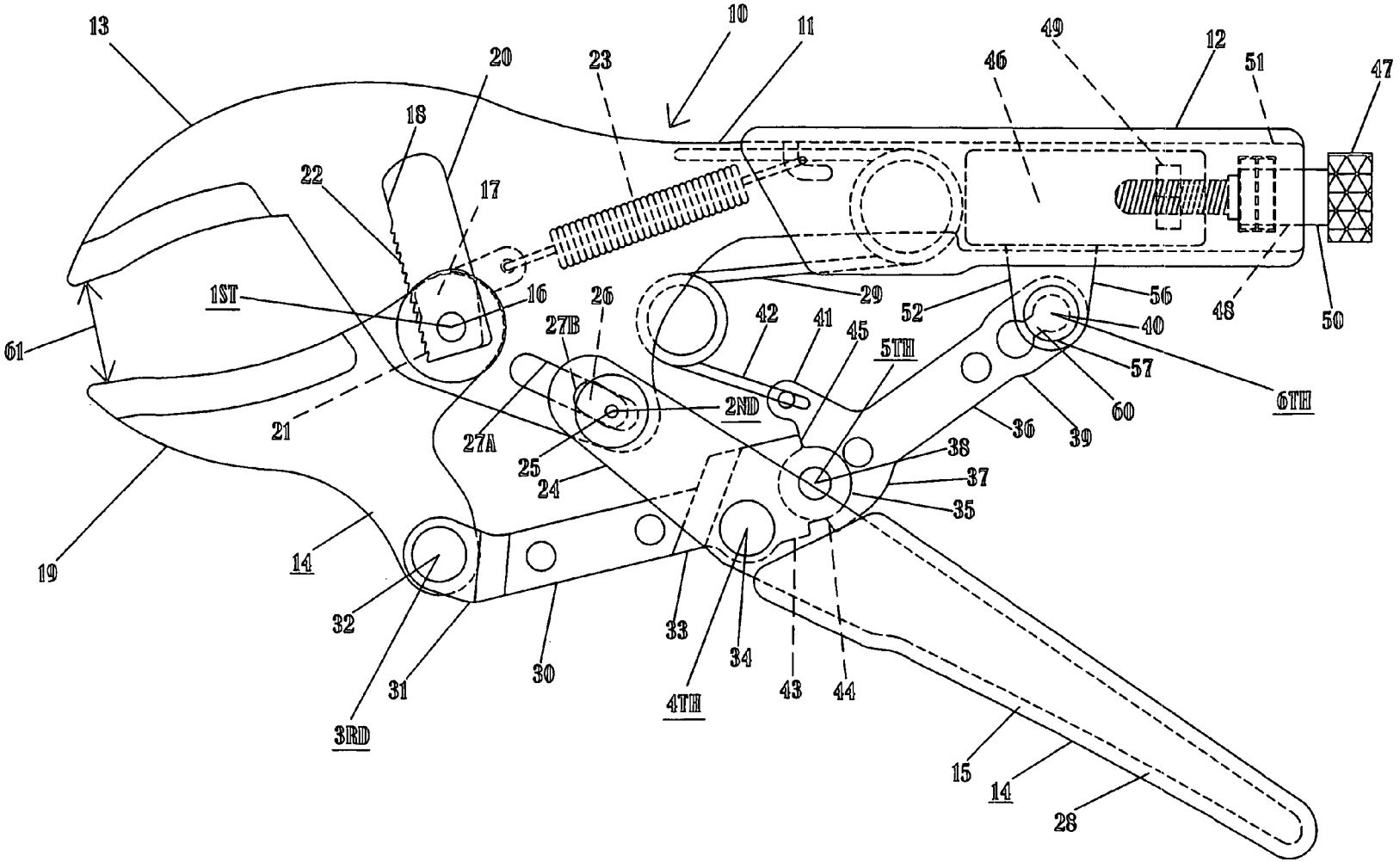
FIG. 5 is a view in side elevation of the pliers shown in FIG. 1 with the jaws shown in a preset closer position for gripping smaller objects.
Figure 6:
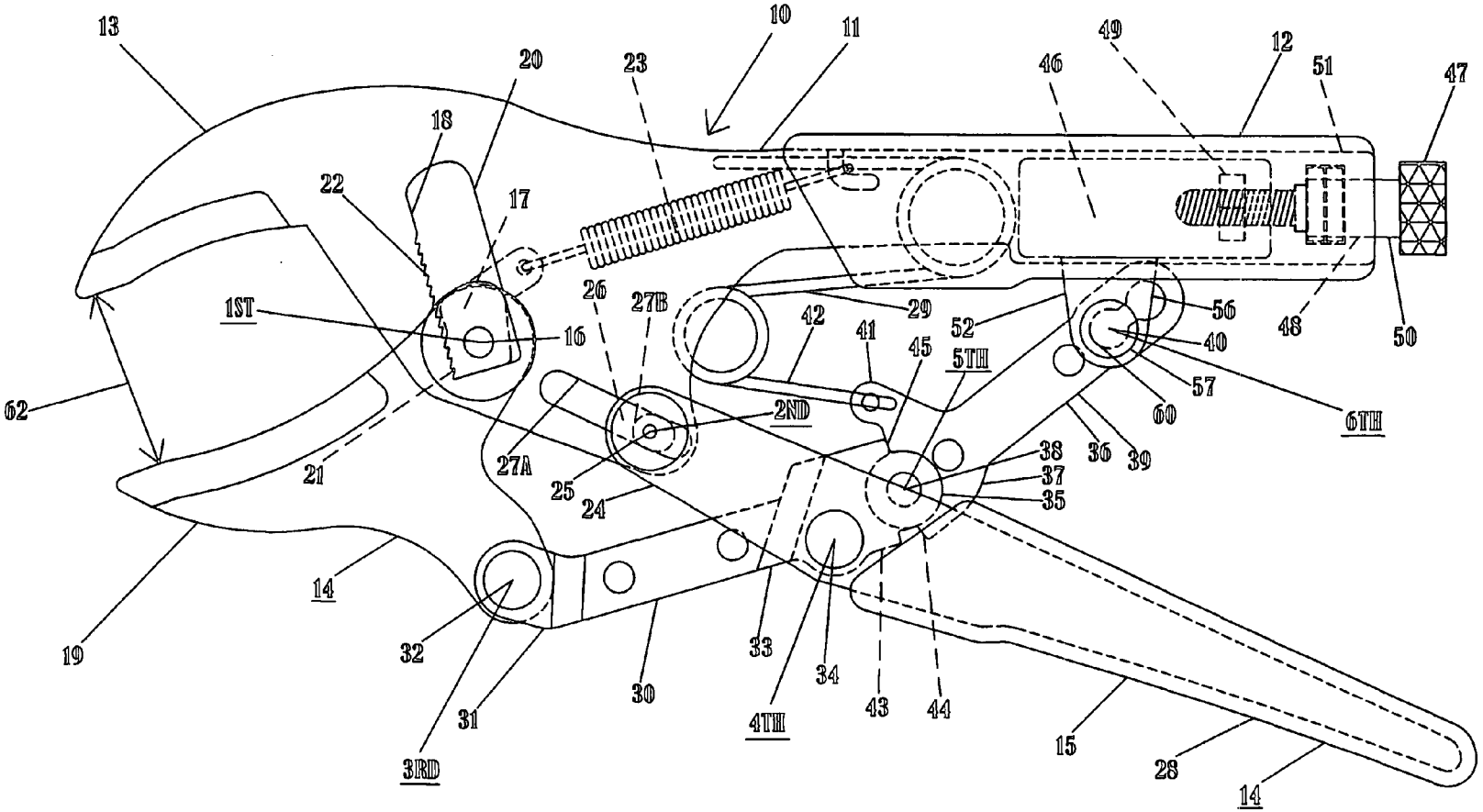
FIG. 6 is a view in side elevation of the pliers shown in FIG. 1 with the jaws preset to a more open position for gripping larger objects.

The sixth pivot 40 is displaceable along the rear end 39 of second link 36 to two alternate positions for presetting the jaws 13 and 19 for gripping larger or smaller objects. FIG. 5 illustrates the pivot 40 in a first position for gripping a smaller object and FIG. 6 illustrates pivot 40 in the second position for gripping a larger object.

In addition, a vernier or fine adjustment is provided wherein the sixth pivot 40 is also adjustable along a length of stationary handle 12 by means of slide 46 received in stationary handle 12. Slide 46 is displaceable within stopped limits with thumb screw 47 which is threadably received in the rear end of stationary handle 12. Thus by making small adjustments to thumb screw 47 either clockwise or counterclockwise within a single revolution, the compression of jaws 13 and 19 as applied to an object is finely adjusted.

Figure 9:
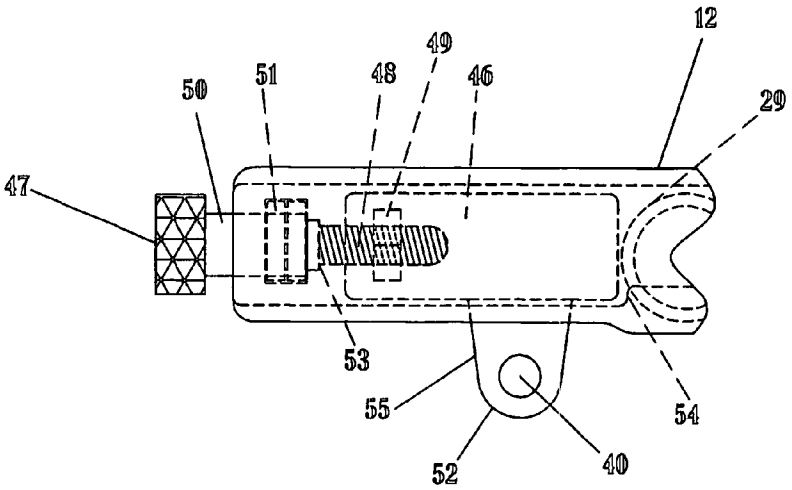
FIG. 9 is an enlarged view in side elevation of the rear portion of the stationary handle shown in FIGS. 7 and 8 from the back side.
Figure 7:
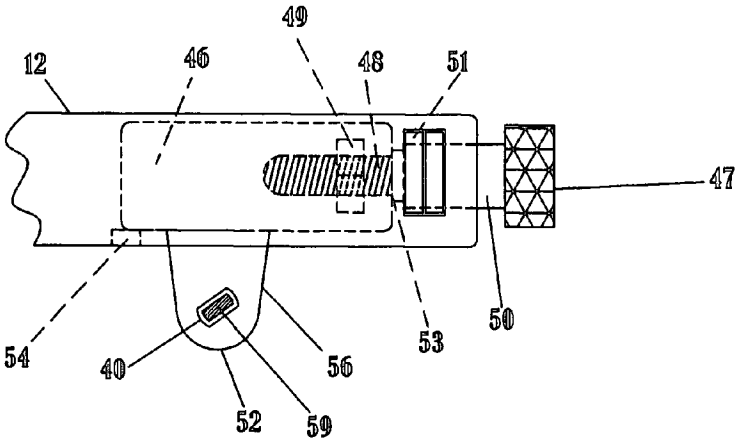
FIG. 7 is an enlarged view in side elevation of the rear portion of the stationary handle of the pliers shown in FIG. 1 disclosing the detail of the adjustable thumb screw and slide mechanism utilized to finally vary the compression pressure applied by the jaws to an object and shown in full back position.
Figure 8:
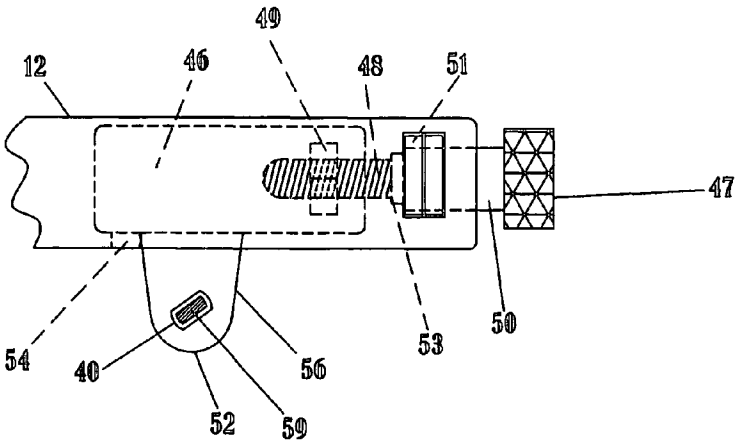
FIG. 8 is an enlarged view in side elevation of the rear portion of the stationary handle shown in FIG. 7 with the thumb screw adjusted to show the slide mechanism in full forward position.

Details of the fine adjustment provided by thumb screw 47 is best illustrated in FIGS. 7, 8 and 9. It can be seen from these figures that the threaded shaft 48 of thumb screw 47 is threadably received within nut 49 which is fixed to slide 46. The shaft portion 50 of thumb screw 47 is received axially in guide 51 for rotation. In turn, downwardly projecting ear 52 is secured to slide 46 and moved therewith to in turn permit the sixth pivot 40 to be adjustable along a length of stationary handle 12. Slide 46 is provided with limits of slidable movement in the longitudinal direction and slide 46 is illustrated in its full back position in FIG. 7 and illustrated in its full forward position in FIG. 8. Stop 53 limits its full back position and stop 54 limits its full forward position.

Downwardly protruding ear 52 is constructed of two spaced ears 55 and 56 as is best illustrated schematically in FIG. 10. Spring biased pushbutton 57 also provides pivot 40. Button 57 is spring biased under its head with compression spring 58. By pressing button 57 inwardly under the compression of spring 58, the flat portion 59 of pivot 40 is permitted to slide from its rearward most position illustrated in FIG. 1 and FIG. 5 in slot 60 of second link 36 to the forward most position in slot 60 as illustrated in FIG. 6 through the narrow portion therebetween. This movement is schematically illustrated in FIGS. 10A, B and C wherein in FIG. 10A the button 57 is illustrated in its preset load position with the compression spring 58 under the least amount of compression and the sixth pivot 40 is in the position illustrated in FIGS. 1 and 5 in the rear portion 39 of link 36, or in the rear most position of slot 60.

FIG. 10B illustrates the pivot 40 in the same position as illustrated in FIG. 10A, but button 57 has been compressed and spring 58 accordingly compressed so that the pivot 40 may be slid forward within slot 60 of link 36 to the forward most position as illustrated in FIG. 6 to accommodate a larger object to be grasped between jaws 13 and 19. Once the pivot 40 has been slid forward to the position illustrated in FIG. 10C, then pushbutton 57 will be released under the compression of spring 58 whereby the rounded portion of pushbutton 57 will seat into the round more forward opening of slot 60 to retain the position illustrated in FIG. 6 between pivot 40 and link 37.

Thus when pivot 40 is in the position illustrated in FIG. 5, the jaws 13 and 19 are pre-positioned for clamping smaller items therebetween as illustrated by the spacing indicated at 61. Alternatively, when sixth pivot 40 is positioned as illustrated in relation to link 36 as shown in FIG. 6, the jaws 13 and 19 are preadjusted to be further apart to accommodate larger objects as is illustrated by the dimension 62 in FIG. 6.

I claim:

1. Locking pliers comprising:

a stationary assembly having an elongated overall shape, wherein one end of said stationary assembly forms a stationary handle, and the other end of said stationary assembly forms a stationary jaw;

a moveable assembly including an operating lever and a moveable jaw that is supported on said stationary jaw via a first pivot;

said operating lever having a front end that is supported directly on said stationary jaw via a second pivot, and a rear end that forms a moveable handle;

a bias spring biasing said moveable handle away from said stationary handle;

said moveable assembly further including a link mechanism pivotally connected between said operating lever, said moveable jaw and said stationary handle and dimensioned whereby said moveable jaw is caused to close toward said stationary jaw from an open position to a closed position for clamping an item between said jaws when said moveable handle is moved toward said stationary handle to provide a past-dead-center locking toggle mechanism.

2. The locking pliers of claim 1, wherein said first pivot is a slidable pivot connection whereby said moveable jaw is permitted to close down on an object disposed between said jaws for providing self-adjustment of said jaws for different sized objects to be gripped between said jaws.

3. The locking pliers of claim 2, wherein said slidable pivot connection includes a spring biased pawl and ratchet mechanism with said pawl secured to said moveable jaw by said first pivot and moveable within a slot extending in said stationary jaw generally transversely to said jaws, said pawl having forwardly facing teeth for engaging a rack of teeth on a front edge of said slot for providing said ratchet, and a pawl spring connected between said pawl and said stationary assembly for maintaining said pawl teeth normally disengaged from said rack teeth.

4. The locking pliers of claim 3, wherein said second pivot is a slidable pivot connection.

5. The locking pliers of claim 4, wherein said bias spring for biasing said moveable handle away from said stationary handle is comprised of a spring disposed between said stationary handle and the front end of said link mechanism.

6. The locking pliers of claim 5, said link mechanism including a first link having a front end supported on said moveable jaw via a third pivot and a rear end supported on said operating lever via a fourth pivot at an intermediate point along said operating lever, and said rear end of said first link having a rearwardly extending protrusion extending beyond said fourth pivot, and a second link having a front end supported on said protrusion of said first link via a fifth pivot and a rear end supported on said stationary handle via a sixth pivot at a resting point that is adjustable along a length of said stationary handle, and stop means for preventing said toggle mechanism from going beyond a point of alignment past dead center upon movement of said moveable handle toward said stationary handle, and a protrusion on the front end of said second link which is dimensioned for retaining an end of said bias spring at a position located in front of said fifth pivot in the open position and in rear of said fifth pivot in the closed position.

7. The locking pliers of claim 6, wherein said bias spring is a torsion spring.

8. The locking pliers of claim 6, wherein said sixth pivot is displaceable along said second link to two alternate positions for presetting said jaws for gripping larger or smaller objects.

9. The locking pliers of claim 6, wherein said stop means also prevents said toggle mechanism from going beyond a point of alignment past dead center upon movement of said moveable handle away from said stationary handle to the open position.

10. The locking pliers of claim 1, wherein said second pivot is a slidable pivot connection.

11. The locking pliers of claim 1, wherein said bias spring for biasing said moveable handle away from said stationary handle is comprised of a spring disposed between said stationary handle and said link mechanism.

12. The locking pliers of claim 11, wherein said spring is a torsion spring.

13. The locking pliers of claim 1, wherein the pivot connection of said link mechanism to said stationary handle is displaceable along said link mechanism to two alternate positions for presetting said jaws for gripping larger or smaller objects.

14. The locking pliers of claim 1, including stop means for preventing said toggle mechanism from going beyond a point of alignment past dead center upon movement of said moveable handle toward or away from said stationary handle to the respective closed or open positions.

15. The locking pliers of claim 1, wherein the pivot connection of said link mechanism to said stationary handle is adjustable along a length of said stationary handle by means of a slide received in said stationary handle and which is displaceable with a thumb screw received in said stationary handle.

16. Self-adjusting locking pliers comprising:

a stationary assembly having an elongated overall shape, wherein one end of said stationary assembly forms a stationary handle, and the other end of said stationary assembly forms a stationary jaw;

a moveable assembly including an operating lever and a moveable jaw that is supported on said stationary jaw via a first pivot which is comprised of a slidable pivot connection whereby said moveable jaw is permitted to close down on an object disposed between said jaws for providing self-adjustment of said jaws for different sized objects to be gripped between said jaws;

said operating lever having a front end that is supported on said stationary jaw via a second pivot which is comprised of a slidable pivot connection, and a rear end of said operating lever that forms a moveable handle;

a spring biasing said moveable handle away from said stationary handle;

said moveable assembly further including a first link having a front end supported on said moveable jaw via a third pivot and a rear end supported on said operating lever via a fourth pivot at an intermediate point along said operating lever whereby said moveable jaw is caused to close toward said stationary jaw from an open position to a closed position for clamping an item between said jaws when said movable handle is moved toward said stationary handle, said rear end of said first link having a rearwardly extending protrusion extending beyond said fourth pivot, and a second link having a front end supported on said protrusion of said first link via a fifth pivot and a rear end supported on said stationary handle via a sixth pivot at a resting point that is adjustable along a length of said stationary handle, whereby said links provide a past-dead-center locking toggle mechanism;

a protrusion on the front end of said second link which is dimensioned for retaining an end of said spring at a position located in front of said fifth pivot in the open position and in rear of said fifth pivot in the closed position; and stop means for preventing said toggle mechanism from going beyond a point of alignment past dead center upon movement of said moveable handle toward said stationary handle to the closed position, and for preventing said toggle mechanism from going beyond a point of alignment past dead center upon movement of said moveable handle away from said stationary handle to the open position.

17. The self-adjusting locking pliers of claim 16, wherein said sixth pivot is adjustable along a length of said stationary handle by means of a slide received in said stationary handle which is displaceable with a thumb screw threadably received in said stationary handle.

18. The self-adjusting locking pliers of claim 17, wherein said sixth pivot is displaceable along said second link to two alternate positions for presetting said jaws for gripping larger or smaller objects.

19. The self-adjusting locking pliers of claim 18, wherein said spring is a torsion spring.

20. The self-adjusting locking pliers of claim 19, wherein said slidable first pivot connection includes a spring biased pawl and ratchet mechanism with said pawl secured to said moveable jaw by said first pivot and moveable within a slot extending in said stationary jaw generally transversely to said jaws, said pawl having forwardly facing teeth for engaging a rack of teeth on a front edge of said slot for providing said ratchet, and a spring connected between said pawl and said stationary assembly for maintaining said pawl teeth normally disengaged from said rack teeth.

* * * * *